United States Patent [19]

Kato et al.

[11] Patent Number: 4,830,100

[45] Date of Patent: May 16, 1989

[54] HEAT-PIPE DEVICE AND HEAT-SINK DEVICE

[75] Inventors: Shuichiro Kato, Kawanishi; Yoshihiro Kinoshita; Masao Kinoshita, both of Osaka, all of Japan

[73] Assignee: The Nippon Aluminium Mfg. Co., Ltd., Osaka, Japan

[21] Appl. No.: 933,890

[22] Filed: Nov. 24, 1986

[30] Foreign Application Priority Data

Nov. 25, 1985 [JP] Japan ..... 60-265569
Nov. 25, 1985 [JP] Japan ..... 60-181632[U]
Feb. 24, 1986 [JP] Japan ..... 61-25406[U]

[51] Int. Cl.[4] ..... F28D 15/02

[52] U.S. Cl. ..... 165/104.14; 165/171; 165/104.33; 126/433; 126/447; 361/385; 29/157.3 H

[58] Field of Search ..... 165/104.14, 171, 104.33; 126/433, 447; 361/385

[56] References Cited

U.S. PATENT DOCUMENTS 3,143,592 8/1964 August ..... 165/104.21
3,384,167 5/1968 Jaukin ..... 165/171
3,437,132 4/1969 Venema ..... 165/80.4
4,285,335 8/1981 Simmons et al. ..... 126/447
4,520,863 6/1985 Andres et al. ..... 165/104.14
4,583,587 4/1986 Alario et al. .

FOREIGN PATENT DOCUMENTS 2947000 7/1980 Fed. Rep. of Germany ..... 361/385
135517 7/1985 Japan .
26268 9/1985 Japan .

*Primary Examiner*—Albert W. Davis, Jr.
*Attorney, Agent, or Firm*—Oliff & Berridge

[57] ABSTRACT

A heat-pipe device for transferring heat generated by a heat-generating element, having at least one heat-pipe body which is an extrudate of plate-like configuration made of aluminum or its alloy, the heat-pipe body including a planer-structure portion which has on one side thereof a flat face to which the heat-generating element is directly fixed, the heat-pipe body further including a plurality of passage-defining portions which protrude from the other side of the planer-structure portion and extend parallel to, and apart a predetermined distance from, each other, each passage-defining portion having therein a flow passage which is fluid-tightly charged with a working fluid for transferring the heat generated by the heat-generating element. Also is disclosed a heat-sink device for cooling a heat-generating element, having at least one heat-pipe body including a planer-structure portion and a plurality of passage-defining portions. The heat-sink device may further have a header pipe, and the heat-pipe body may be bent to form a box-like configuration such that the longitudinal ends of flow passages within the passage-defining portions are open in a communication passage within the header pipe. The heat-sink device may further have a first and second header pipe, and the heat-pipe body may be disposed vertical such that the flow passages run in a horizontal direction and are open in a first and second communication passages within the first and second header pipes.

11 Claims, 14 Drawing Sheets a
b
10
12
14
16
18
20
22
23
24
25
26
28
30
32

HEAT-PIPE DEVICE AND HEAT-SINK DEVICE

BACKGROUND OF THE INVENTION

1. Field of the Art

The present invention relates in general to a heat-pipe device and a heat-sink device, and in particular to such a heat-pipe and a heat-sink device which are advantageously used for cooling a member generating a large amount of heat, such as a large-capacity semiconductor element.

2. Related Art Statement

A large-capacity semiconductor element, such as a large-capacity thyristor or transistor, generates a large amount of heat in a short time. For the purpose of sufficiently cooling such a semiconductor element, a semiconductor-associated heat pipe or heat sink is required to have a large heat-transmission capacity. Such a heat pipe must have a plurality of passage pipes in which a fluid flows for transmitting heat generated by the semiconductor element.

There are known various kinds of heat pipes. For example, a Japanese Patent Application (laid open in 1985 under Publication No. 60-26268) discloses a heat pipe which includes a plurality of separate passage pipes, together with a fin member and a plate member which are attached to the passage pipes. Another conventional heat pipe is of a type in which a plurality of passage pipes are in communication with each other by way of a pair of communication header pipes, and in which a fin member and a plate member are attached to the passage pipes. The third heat pipe known in the art is manufactured in a so-called "roll-bond" process, in which a plurality of passages are formed between a pair of plate members which are rolled under pressure. The fourth example of the conventional-type heat pipes includes an extrudate member which has therein a plurality of flow passages, and a pair of header pipes which are attached to the extrudate member.

However, the first example disclosed by the Japanese Patent Application has a problem of having a comparatively high heat resistance at the connections between the passage pipes and the plate and at the connections between the passage pipes and the fin member. Another problem with the first example is that its heat-transmission capacity is comparatively low at any local portions, since the passage pipes are separate from each other.

The second example above indicated has a higher heat-transmission capacity than the first one, since the second heat pipe has the communication header pipes for communicating the plurality of passage pipes. However, the second example has a problem, like the first one, that its heat resistance is comparatively high at the connections between the passage pipes and the plate member and at the connections between the passage pipes and the fin member.

The third example has a simple structure in which the plate members serve as passage-defining members, but suffers a problem that fin-defining portions formed adjacent to the passages are comparatively small.

The fourth heat pipe identified above has no plate member, and therefore it is impossible to directly fix a heat-generating member to the heat pipe.

SUMMARY OF THE INVENTION

It is therefore an object of the invention to provide a heat-pipe device which has a large capacity for heat transmission and to which a heat-generating member is directly fixed.

It is another object of the invention to provide a heat-sink device which has a large heat-transmission capacity and to which a heat-generating member is directly fixed.

It is a further object of the invention to provide a heat-sink device, having a box-like configuration, which has a large heat-transmission capacity and which has a simple construction.

It is a further object of the invention to provide a heat-sink device, including a plate-like heat-pipe body, which has an improved efficiency of heat transmission and which is advantageously disposed in a narrow space.

According to a first aspect of the present invention, there is provided a heat-pipe device for transferring heat generated by a heat-generating element, comprising at least one heat-pipe body which is an extrudate of plate-like configuration made of aluminum or its alloy, the at least one heat-pipe body including a planer-structure portion which has on one of opposite sides thereof a flat face to which the heat-generating element is directly fixed, the at least one heat-pipe body further including a plurality of passage-defining portions which protrude from the other side of the planer-structure portion and extend parallel to, and apart a predetermined distance from, each other, each passage-defining portion having therein a flow passage which is fluid-tightly charged with a working fluid for transferring the heat generated by said heat-generating member.

The heat-pipe device constructed as described above has a decreased heat resistance at the connection portions between the planer-structure portion and the plurality of passage-defining portions, since the at least one heat-pipe body is an extrudate and therefore has a continuous metal structure. Accordingly, the heat pipe has an improved efficiency of cooling the heat-generating element, i.e., transmitting the heat from the element.

The at least one heat-pipe body has the plurality of flow passages in which the working fluid flows for transmitting the heat generated by the heat-generating element. Therefore, the heat-pipe device has an increased heat-transmission capacity. Owing to the flat face, the area of contacting parts (interface) between the at least one heat-pipe body and the heat-generating element is increased. Accordingly, the flat face of the at least one heat-pipe body contributes to increasing the heat-transmission efficiency of the heat-pipe device, allowing the heat generated by the heat-generating element to be transmitted through a large area of the entire interface between the heat-generating element and the at least one heat-pipe body.

In a preferred embodiment of the heat-pipe device according to the present invention, each of the plural passage-defining portions has a flattened tube configuration, whereby the plurality of passage-defining portions cooperate with the planer-structure portion to define a corrugation face on the other side of the planer-structure portion.

In another embodiment according to the first aspect of the invention, the heat-pipe device further comprises a first and a second header pipe which have therein a first and a second communication passage, respectively. Each of the flow passages of the plurality of passage-defining portions is open, at longitudinal ends of the corresponding passage-defining portion, in the respective first and second communication passages of the first and second header pipes.

In the above case, the heat-pipe device has a higher heat-transmission capacity owing to the first and second header pipes.

In a preferred form of the above-indicated embodiment, the heat-pipe device further comprises heat-radiating means such as a fin member. The at least one heat-pipe body is disposed substantially vertical, while one of the first and second header pipes is located higher than the other of the first and second header pipes. The heat-generating element is fixed to the lower part of the at least one heat-pipe body. The heat-radiating means is mounted on the upper part of the at least one heat-pipe body.

In a further embodiment of the heat-pipe device according to the first aspect of the invention, the at least one heat-pipe body further includes a plurality of heat-radiating fins. Each heat-radiating fin is formed by means of being bent up from part of the planer-structure portion free from the passage-defining portions after being cut along a periphery thereof in the part of the planer-structure portion.

According to a second aspect of the present invention, there is provided a heat-sink device for cooling a heat-generating element, comprising: at least one heat-pipe body which is an extrudate of plate-like configuration made of aluminum or its alloy, the at least one heat-pipe body including a planer-structure portion which has on one of opposite sides thereof a flat face to which the heat-generating element is directly fixed, the at least one heat-pipe body further including a plurality of passage-defining portions which protrude from the other side of the planer-structure portion and extend parallel to, and apart a predetermined distance from, each other, each passage-defining portion having therein a flow passage which is fluid-tightly charged with a working fluid for transferring heat generated by the heat-generating element.

The heat-sink device constructed as described above has advantages similar to the heat pipe according to the first aspect of the present invention. That is, the heat-sink device has an increased cooling effect on the heat-generating element owing to the extrudate structure of the at least one heat-pipe body, and a higher heat-transmission capacity owing to the flat face of the at least one heat-pipe body.

In a preferred embodiment of the heat-sink device according to the second aspect of the invention, each of the plurality of passage-defining portions has a flattened tube configuration, and the plurality of passage-defining portions cooperate with the planer-structure portion to define a corrugation face on the other side of the planer-structure portion.

In another embodiment according to the second aspect of the invention, the heat-sink device further comprises a first and a second header pipe which have therein a first and a second communication passage, respectively. Each of the flow passages of the plurality of passage-defining portions is open, at longitudinal ends of the corresponding passage-defining portion, in the respective first and second communication passages of the first and second header pipes.

In the above case, the heat-sink device has a still higher heat-transmission capacity.

In a preferred form of the above embodiment of the heat-sink device, the at least one heat-pipe body is bent to form a substantially box-like configuration, such that the first and second header pipes are positioned adjacent to each other.

In another form of the same embodiment, the heat-sink device further comprises heat-radiating means such as a fin member. The at least one heat-pipe body is disposed substantially vertical, while one of the first and second header pipes is located higher than the other of the first and second header pipes. The heat-generating element is fixed to the lower part of the at least one heat-pipe body. The heat-radiating means is mounted on the upper part of the at least one heat-pipe body.

In a still further embodiment of the heat-sink device according to the second aspect of the invention, the at least one heat-sink body further includes a plurality of heat-radiating fins. Each heat-radiating fin is formed by means of being bent up from part of the planer-structure portion free from the passage-defining portions after being cut along a periphery thereof in the part of the planer-structure portion.

According to a third aspect of the present invention, there is provided a heat-sink device for cooling a heat-generating element, comprising (a) a header pipe having therein a communication passage; and (b) at least one heat-pipe body which is an extrudate of plate-like configuration made of aluminum or is alloy and which is bent to form a substantially box-like configuration, the at least one heat-pipe body including a planer-structure portion which has on one of opposite sides thereof a flat face to which the heat-generating element is directly fixed, the at least one heat-pipe body further including a plurality of passage-defining portions which protrude from the other side of the plane-structure portion and extend parallel to, and apart a predetermined distance from, each other and which cooperate with the planer-structure portion to define a corrugation face on the other side of the planer-structure portion, each passage-defining portion having therein a flow passage which is open, at longitudinal ends of the corresponding passage-defining portion, in the communication passage of the header pipe, the flow passage of the plurality of passage-defining portions and the communication passage of the header pipe being fluid-tightly charged with a working fluid for transferring heat generated by the heat-generating element.

The above-indicated heat-sink device enjoys an increased heat-transmission capacity, like in the first and second aspects of the invention. The present heat-sink device has a simple construction, since the device uses a sole header pipe.

In a preferred embodiment of the heat-sink device according to the third aspect of the invention, the heat-sink device is disposed such that the header pipe is located in a bottom wall of the heat-sink device.

In the heat-sink device constructed as described above, the header pipe which is provided in the bottom wall of the at least one heat-sink body and which stores the working fluid contributes to more rapidly transmitting the heat from the heat-generating element to the upper part of the at least one heat-pipe body where the heat-radiating means is disposed. Accordingly, the heat-sink device has an increased heat-transmission efficiency.

In another embodiment of the heat-sink device according to the third aspect, the flat face of the at least one heat-pipe body defines an external face of the heat-sink device, and the heat-generating element is fixed to the external face of the bottom wall of the heat-sink device.

In a preferred form of the above embodiment, the heat-sink device further comprises heat-radiating means such as a fin member. The heat-radiating means is disposed on the upper part of the corrugation face of the at least one heat-pipe body.

According to a fourth aspect of the present invention, there is provided a heat-sink device for cooling a heat-generating element, comprising; (a) a first and a second header pipe which have therein a first and a second communication passage, respectively; and (b) at least one heat-pipe body which is an extrudate of plate-like configuration made of aluminum or its alloy and which is disposed substantially vertical, the at least one heat-pipe body including a planer-structure portion which has on one of opposite sides thereof a flat face, the heat-generating element being fixed to a middle portion of the lower part of said flat face of said planer-structure portion, the at least one heat-pipe body further including a plurality of passage-defining portions which protrude from the other side of the planer-structure portion and extend parallel to, and apart a predetermined distance from, each other and which cooperate with the planer-structure portion to define a corrugation face on the other side of the planer-structure portion, each passage-defining portion having therein a flow passage which runs in a substantially horizontal direction and which is open, at longitudinal ends of the corresponding passage-defining portion, in the respective first and second communication passages of the first and second header pipes, the flow passages of the plurality of passage-defining portions and the first and second communication passages of the first and second header pipes being fluid-tightly charged with a working fluid for transferring heat generated by the heat-generating element.

In the heat-sink device constructed as described above, the heat-generating element is fixed to the middle portion of the lower part of the at least one heat-pipe body which is disposed substantially vertical. After vaporized due to heat generated by the heat-generating element, the working fluid flows, in the flow passages within the lower part of the at least one heat-pipe body, bidirectionally, i.e., toward the respective first and second header pipes. Then, the gaseous working fluid moves up the first and second header pipes and reaches the flow passages within the upper part of the at least one heat-pipe body where the working fluid is cooled and condensed into liquid, and flows backward to the lower part of the at least one heat-pipe device. As a result, the heat generated by the heat-generating element is transmitted by the working fluid through an increased number of flow passages. This arrangement contributes to not only increasing the heat-transmission efficiency of the heat-sink device, but also evening more uniformly the temperature of the overall surface of the at least one heat-pipe body.

BRIEF DESCRIPTION OF THE DRAWINGS

The foregoing and optional objects, advantages and features of the present invention will become apparent by reading the following detailed description of preferred embodiments of the invention, when considered in connection with the accompanying drawings, in which.

DETAILED DESCRIPTION OF THE PREFERRED EMBODIMENTS

Referring to the accompanying drawings, the preferred embodiments of the invention will now be described in detail.

Figure 1:
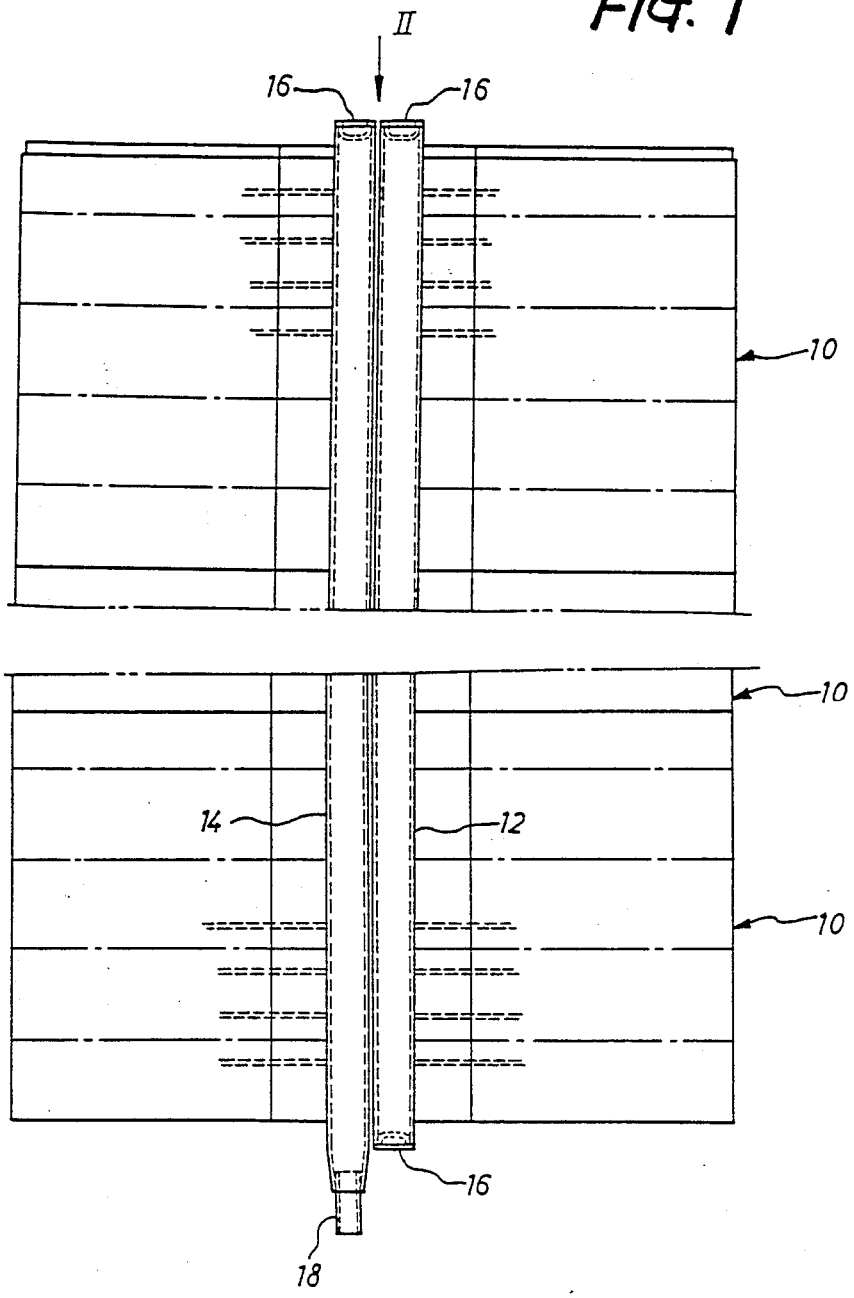
FIG. 1 is a front elevational view of a preferred embodiment of a heat-sink device according to the present invention.

Referring first to the front elevational view of FIG. 1, there is shown a heat sink device for cooling a heat-generating element such as a semiconductor, which embodies the present invention. The heat sink device consists mainly of three heat-pipe bodies 10, 10, 10 which have a plate-like configuration. The three heat-pipe bodies 10 each are an extrudate of aluminum or its alloy (which will be described), and joined to each other.

Figure 2:
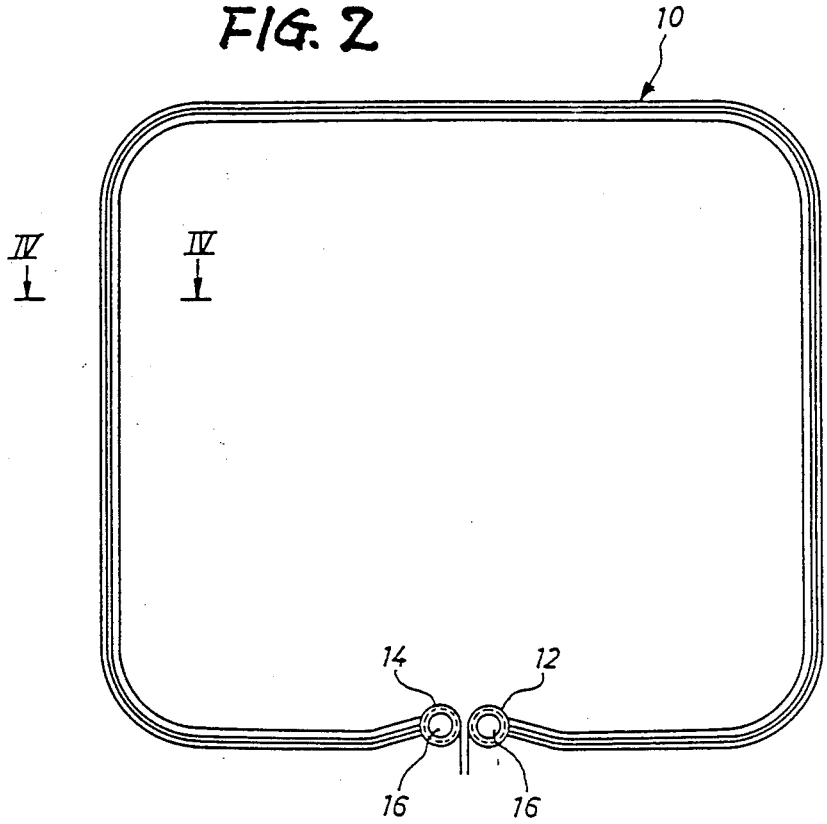
FIG. 2 is a plane view of the heat-sink device of FIG. 1, as seen along arrow II.
Figure 3B:
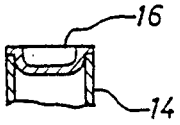
FIGS. 3*b* and 3*c* are cross sectional views of a portion a and portion b of FIG. 3*a*, respectively.
Figure 3C:
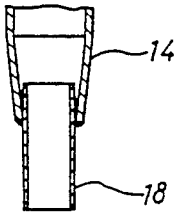
Figures 3A, 4:
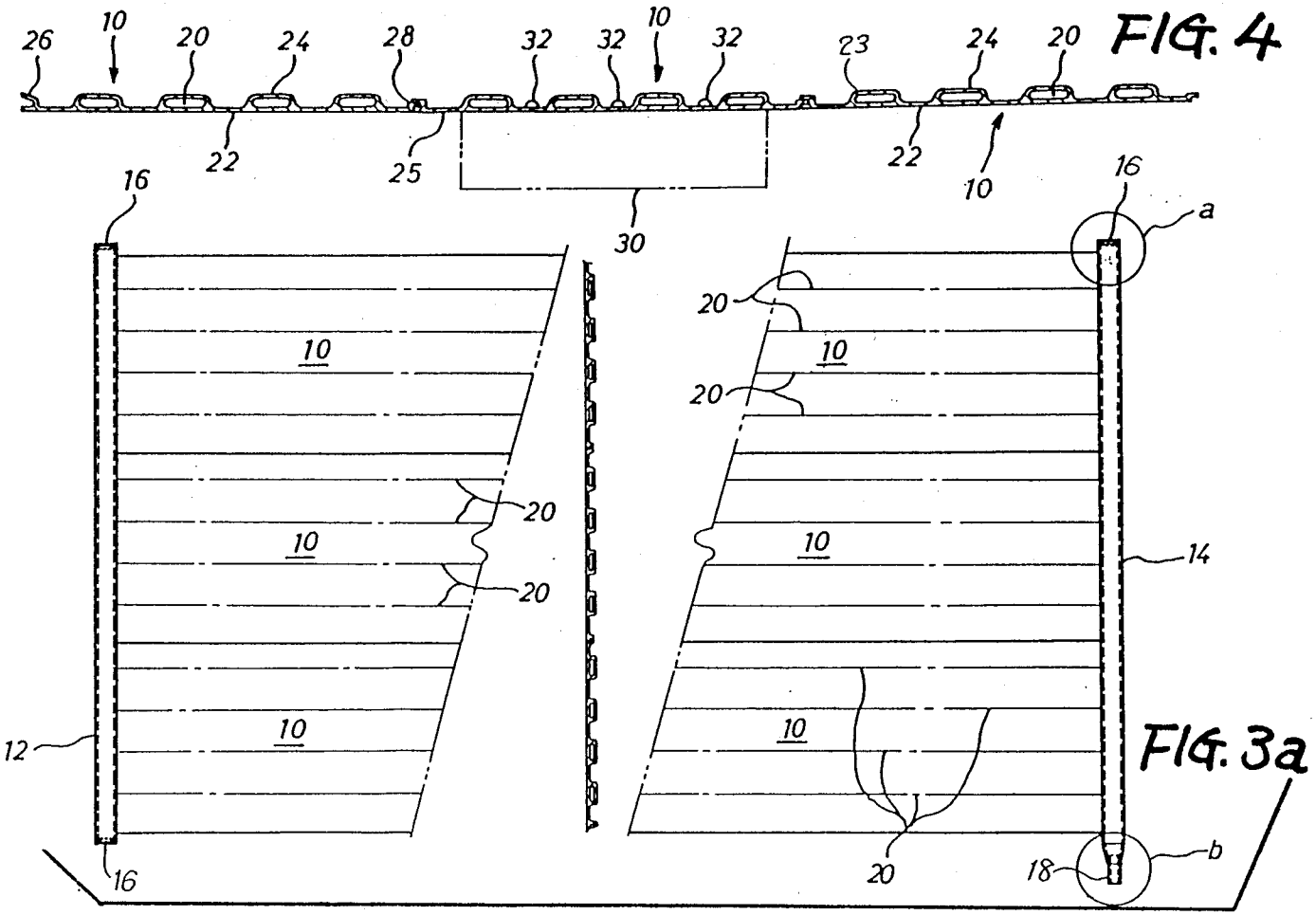
FIG. 3*a* is an exploded view of the heat-sink device of FIG. 1, showing a heat-pipe body used in the heat-sink device.
FIG. 4 is a cross sectional view of the heat-pipe body, taken long line IV—IV of FIG. 2.

As clearly shown in FIG. 2, the joined heat-pipe bodies 10 are bent to form a substantially box-like (square cross section) configuration with their corners rounded. The joined heat-pipe bodies 10 are connected at longitudinal ends thereof to respective first and second header pipes 12, 14 which have therein a first and second communication passage, respectively. A sealing cap 16, 16, 16 (FIG. 3*b*) is fluid-tightly fixed by brazing to each of the upper and lower ends of the first header pipe 12, and to the upper end of the second header pipe 12 (FIG. 3*a*). To the lower end of the second header pipe 14, is fixed a pipe 18 (FIG. 3*c*) through which remaining air within the joined heat-pipe bodies 10 and the first and second communication passages of the first and second header pipes 12, 14 is discharged by suction. The pipe 18 is fluid-tightly closed by caulking and brazing, after the joined heat-pipe bodies 10 and the header pipes 12, 14 were charged to the extent of 10 to 50% by volume with a working fluid, following the suction operation of the remaining air. The working fluid is a mixture of methanol, acetone, flon and the like, and serves as a medium for transmitting heat.

In the exploded view of FIG. 3*a*, each 10 of the joined three heat-pipe bodies has four flow passages 20 which are charged with the working fluid indicated above.

More specifically described referring to FIG. 4, one heat-pipe body 10, an extrudate of aluminum or its alloy, consists of a planer-structure portion 22 and four passage-defining portions 24. The planer-structure portion 22 of the heat-pipe body 10 has on one of opposite sides thereof a flat face 25 to which a heat-generating element 30 is directly fixed. The four passage-defining portions 24 of the heat-pipe body 10 protrude from the other side of the planer-structure portion 22, and extend parallel to, and apart a predetermined distance from, each other. The passage-defining portions 24 cooperate with the planer-structure portion 22 to define a corrugation face 23. Each of the four passage-defining portions 24 has therein one flow passage 20, and has a substantially flattened tube configuration. One heat-pipe body 10 has a first and a second joint portion 26, 28 at transverse ends thereof other than the longitudinal ends thereof at which the heat-pipe body 10 is connected to the first and second header pipes 12, 14. The first joint portion 26 of one heat-pipe body 1 is joined by fitting and caulking to the second joint portion 28 of the next heat-pipe body 10.

The joined heat-pipe bodies 10 is connected to the first and second header pipes 12, 14 as follows; first, the longitudinal ends of the heat-pipe bodies 10 are worked so that the ends of the passage-defining portions 24 protrude from the rest of the heat-pipe bodies 10, and then the protruding ends of the passage-defining portions 24 each are connected by fitting and brazing to the corresponding hole formed in the first and second header pipes 12, 14. Thus, the flow passages 24 of the joined heat-pipe bodies 10 and the first and second communication passages of the header pipes 12, 14 communicate with each other.

The heat-generating element 30 which is directly fixed to the flat face 25 (FIG. 4) of the heat-pipe bodies 10 may be a semiconductor device such as a thyristor. In FIG. 2, the heat-generating element 30 will be fixed to the external face of the instant heat-sink device. The heat-generating element 30 fixed is in close contact with the flat face 25 over the entire interface between the element 30 and the bodies 10. The element 30 is fixed to the flat face 25 by the help of a plurality of screw 32 which are screwed through the part of planer-structure portion 22 free from the passage-defining portions 24.

The joined heat-pipe bodies 10 has a high heat-transmission capacity, since one heat-pipe body 10 has four flow passages 20 in which the working fluid flows for transferring heat generated by the heat-generating element 30.

Each heat-pipe body 10 is an extrudate of aluminum or the like, and the planer-structure portion 22 and the passage-defining portions 24 are formed as integral parts. That is, the heat-pipe body 10 has a continuous metal structure. Accordingly, the heat resistance of the heat-pipe body 10 is low. The heat flow from the passage-defining portions 24 is rapidly transmitted to the planer-structure portion 2. The heat flow transmitted to the planer-structure portion 22 is further transmitted to the heat-generating element 30 fixed to the flat face 25 of the planer-structure portion 22, cooling down the temperature of the heat-generating element 30.

Since the heat-pipe bodies 10 and the heat-generating element 30 are in close contact with each other, the heat flow is transmitted to the element 30 through the entire interface between the heat-pipe bodies 10 and the element 30. That is, the heat flow is transmitted from the heat-pipe bodies 10 to the element 30 through a large area. Thus, the heat-generating element 30 is rapidly cooled, i.e., cooled with an improved efficiency.

The inventors have conducted a performance test on a test model 40 (FIG. 5), so as to study the performance or quality of the heat-pipe body 10 as a main part of the instant heat-sink device.

Figure 5:
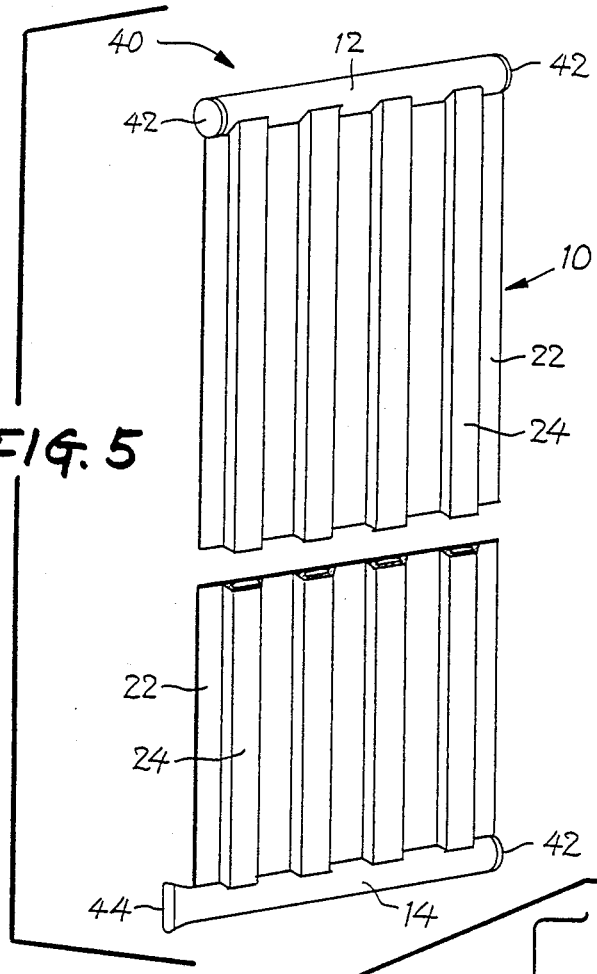
FIG. 5 is a perspective view of a test model of a heat-sink device according to the present invention.

As shown in FIG. 5, the test model 10 consists of a heat-pipe body 10 and a first and a second header pipe 12, 14 joined to respective longitudinal ends of the heat-pipe body 10. The heat-pipe body 10 is an extrudate of plate-like configuration made of aluminum or its alloy. The first and second header pipes 12, 14 are formed of a pipe coated with brazing materials. A sealing cap 42, 42, 42 coated with brazing materials is fixed to opposite ends of the first header pipe 12 and to one of opposite ends of the second header pipe 14. The test model 10 thus constructed is brazed by heating in a vacuum heating furnace. The other end 44 of the second header pipe 14 is closed by welding after the test model 40 is charged with a working fluid (described below).

The test model 40 is 48 mm in width and 550 mm in length, and has an internal volume 52 cc. The internal volume 52 cc of the test mode 40 include an internal volume 10 cc of the first and second header pipes 12, 14.

Figure 6:
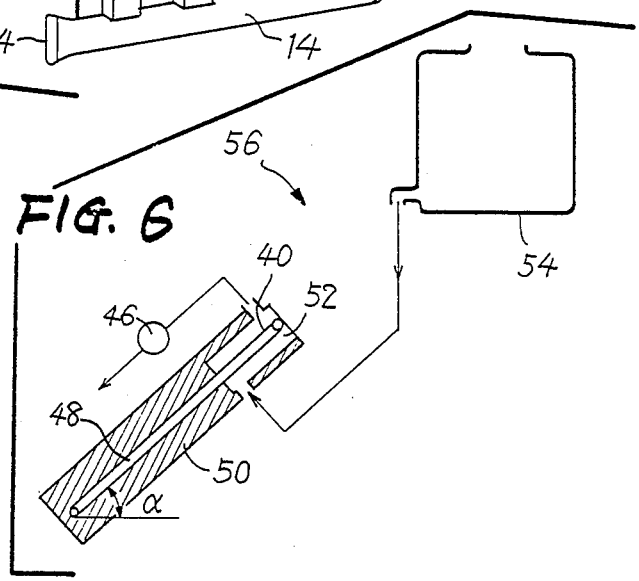
FIG. 6 is a schematic view of an apparatus for practicing a performance test on the test model of the heat-sink device of FIG. 5.

In the performance test, the test model 40 first was mounted on a performance-test apparatus 56 shown in FIG. 6. Second, the amount of heat transmitted by the heat-pipe body 10 was measured by a calorimeter 46, at various slopes $\alpha$ (slope $\alpha$ is changeable within a range of 5° to 90°). In FIG. 6, reference numerals 50, 52, and 54 designate a heat insulator, a water-cooled jacket, and a tank, respectively.

In the case where the test was conducted on the test model 40 charged to the level of 20% by volume with the working fluid (methanol), a maximum value of the amount of heat transmitted by the heat-pipe body 10 was 560 Kcal/hour, with the slope $\alpha$ changed within the range of 45° to 90°. Judging from this result, it is said that the instant heat-pipe body 10 is advantageous for use in a heat-sink device for cooling such heat-generating members as output a large amount of heat in a short time, for example, a large-capacity thyristor, transistor or thermomodule.

As is apparent from the foregoing detail description, the heat-pipe body 10 of plate-like configuration according to the present invention enjoys a reduced heat resistance and therefore has a good cooling effect. This is because the body 10 is an extrudate that includes, as integral parts, the planer-structure portion 22 to which the heat-generating element 30 is directly fixed, and also the passage-defining portions 24 each having therein the flow passage 20 in which the working fluid flows for transmitting heat generated by the heat-generating element 30, that is, because the body 10 has a continuous metal structure at the connection portions between the planer-structure portion 22 and the passage-defining portions 24.

Further, the flat face 25 of the heat-pipe body 10 permits the heat-generating element 30 to be fixed thereto in close contact therewith. The close contact of the element 30 with the body 10 permits heat flow to be transmitted to the element 30 through a large area, i.e., the entire interface between the element 30 and the flat face 25 of the body 10. Accordingly, the heat-pipe body 10 is capable of transferring a large amount of heat in a short time.

In the case where the heat-pipe body 10 is provided at longitudinal ends thereof with the pair of header pipes 12, 14, the heat transmission capacity of the heat-pipe body 10 is further increased.

There will be described other embodiments of the heat-sink device which includes one or more heat-pipe bodies.

Figure 7:
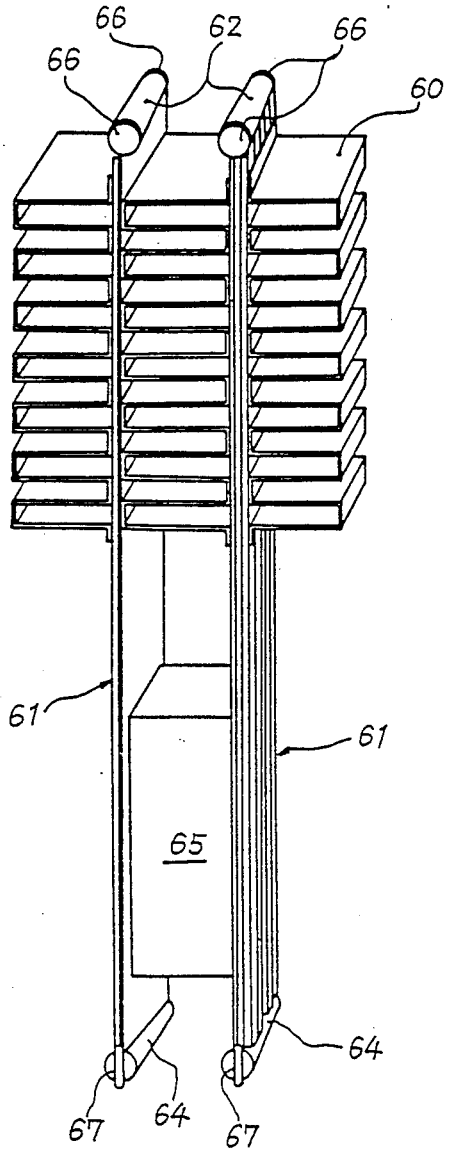
FIGS. 7 and 8 are perspective views of other embodiments of the heat-sink device, respectively.

Referring to FIG. 7, there is shown a heat-sink device which includes a pair of heat-pipe bodies 61, 61 which are opposed to each other. The heat-sink device is provided with heat-radiating means in the form of three fin members 60 mounted on the upper part of the two heat-pipe bodies 10. A heat-generating element 65 is fixed to the lower part of the bodies 10. The heat-generating element 65 may be of the 1 KW class.

The fin members 60 have a coat of brazing materials, while sealing caps 66 are members formed of a metal sheet coated with brazing materials. A pair of first header pipes 62 and a pair of second header pipes 64 are formed using a metal pipe coated with brazing materials. An assembly (FIG. 7) of the heat-sink device is brazed within a vacuum heating furnace, in a so-called "vacuum brazing" process. Ends 44 of the second header pipes 64 are closed like the ends 44 of the test model 40 of FIG. 5. Closed ends 67 are like the ends 44 of the test model 40 of FIG. 5.

Figure 8:
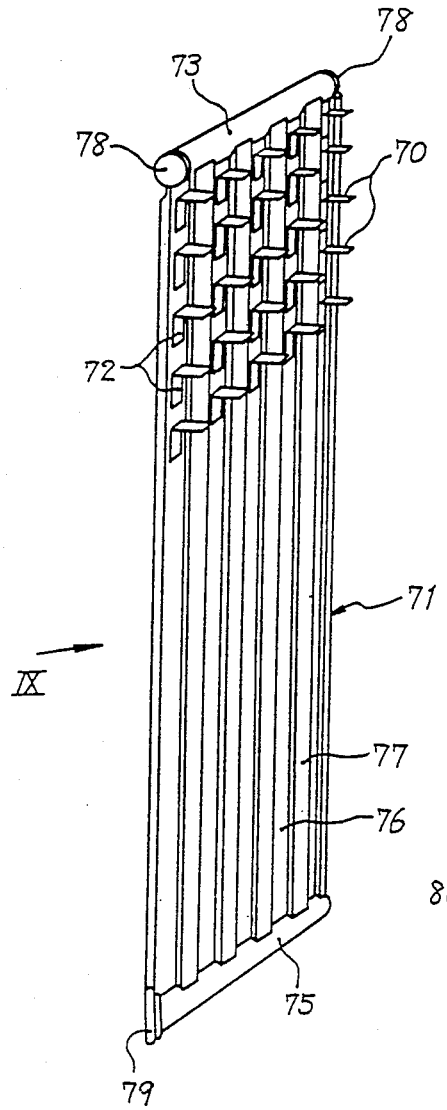
Figure 9:
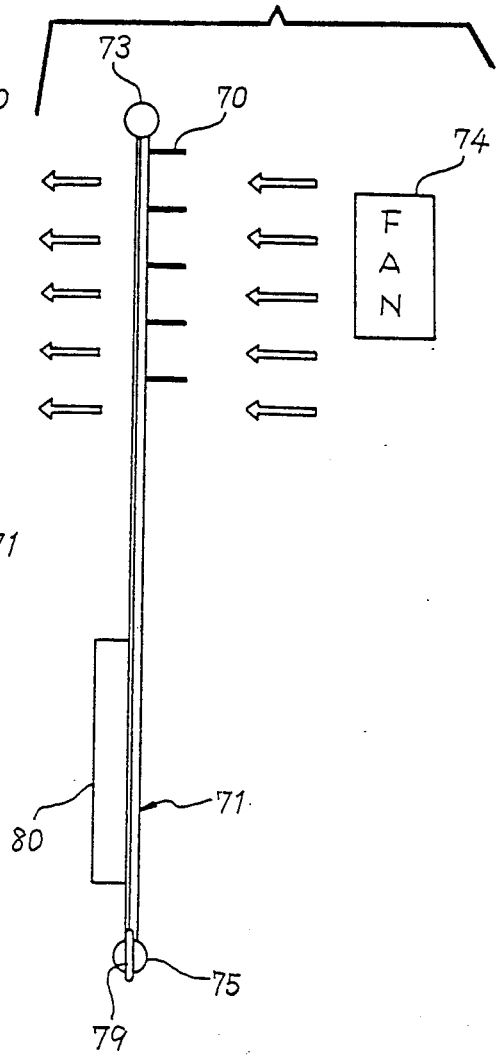
FIG. 9 is a view of the heat-sink device of FIG. 8, as seen along arrow IX.

In FIGS. 8 and 9, another embodiment of the heat-sink device is shown. This heat-sink device is suitable for a 300 W-class heat-generating element 80. In FIG. 8, a heat-pipe body 71 has heat-radiating means in the form of a plurality of fins 70. Each fin 70 is formed by means of being bent up after being cut along its periphery in the part of a planer-structure portion 76 free from the passage-defining portions 77. Consequently, the planer-structure portion 76 has the same number of windows 72 as that of the fins 70. In FIG. 9, there is shown an electric fan 74. With the help of forced air flow from the electric fan 74 through the windows 72, the fins 70 effect an increased amount of heat radiation in spite of their narrow area. In FIGS. 8 and 9, reference numerals 73, 75, 78, and 79 designate a first header pipe, a second header pipe, sealing caps, and a closed end, respectively, which have the same structure and function as the respective members 12, 14, 42, 44 of the test model 40 of FIG. 5.

Figure 10:
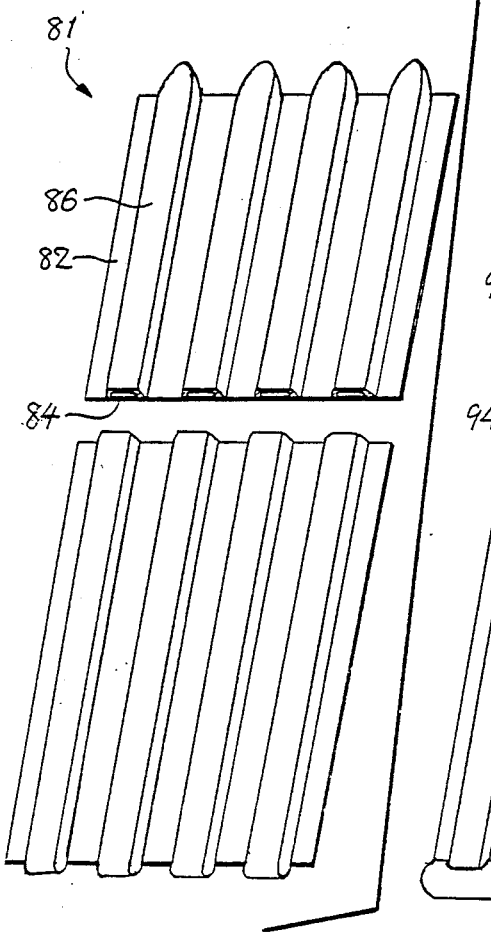
FIG. 10 is a schematic view of another embodiment of the heat-sink device according to the present invention.
Figure 11:
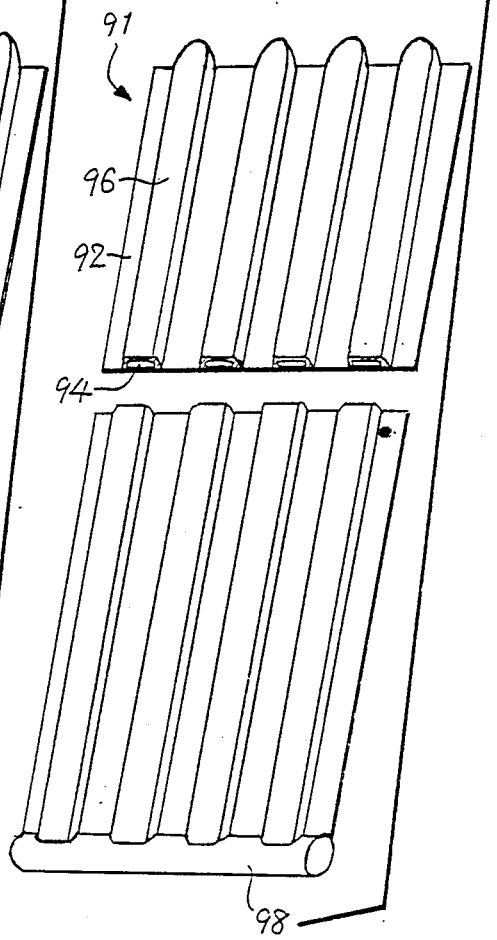
FIG. 11 is a schematic view of a further embodiment of the heat-sink device of the invention.

There are shown further embodiments according to the invention in FIGS. 10 and 11. FIG. 10 shows a heat-pipe body 81 similar to the previously described heat-pipe bodies 10, 61, 71, except that a plurality of flow passages 94 within the plurality of passage-defining portions 96 are completely separate from each other. Reference numeral 82 designates a planer-structure portion of the heat-pipe body. This arrangement is advantageous in that, even if one flow passage 94 is broken, the remaining flow passages 94 normally function.

FIG. 11 shows a heat-pipe body 91 which is similar to the heat-pipe body 81 of FIG. 10, except that a plurality of flow passages 94 defined by a plurality of passage-defining portions 96 communicate with each other by way of a sole header pipe 98. Reference numeral 92 designates a planer-structure portion.

Figure 12:
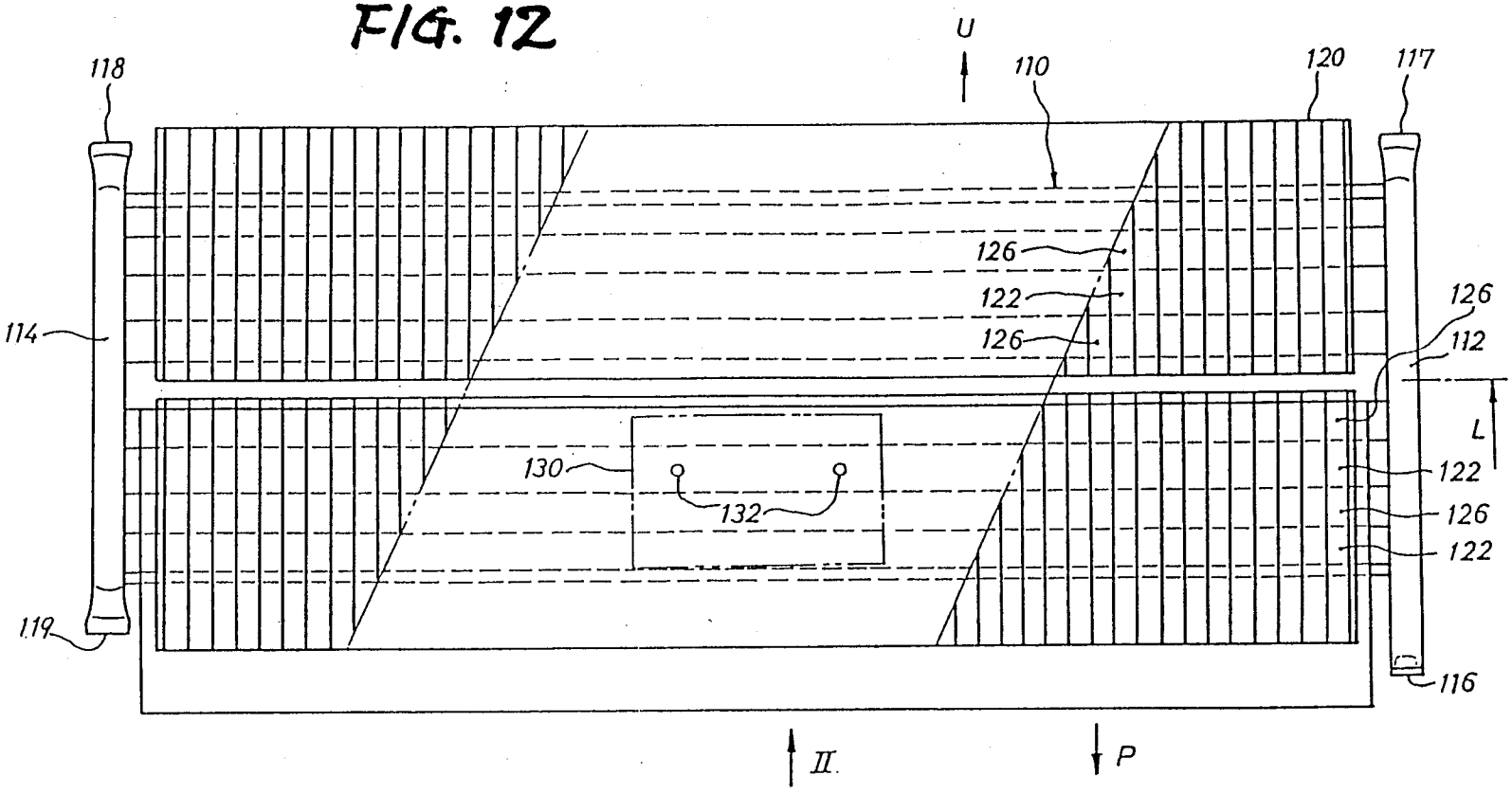
FIG. 12 is a view of still another embodiment of the heat-sink device of the invention.
Figure 13:
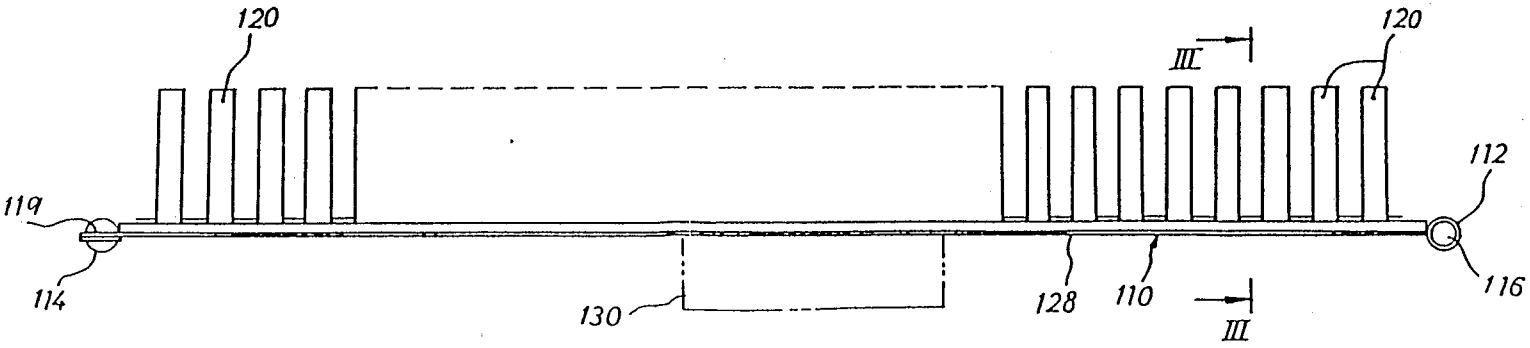
FIG. 13 is a view of the heat-sink device of FIG. 12, as seen along arrow XIII.
Figure 14:
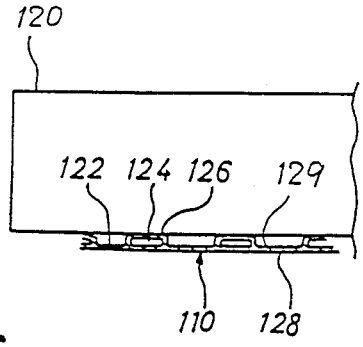
FIG. 14 is a cross sectional view of a heat-pipe body of the heat-pipe device of FIG. 12, taken along line XIV—XIV of FIG. 13.

FIGS. 12, 13, 14 show a further embodiment of the heat-sink device according to the present invention, in which a heat-pipe body 110 of plate-like configuration is disposed substantially vertical with its passage-defining portions 126 extending in a horizontal direction. In FIG. 12, arrow U indicate the upper side of the heat-sink device, while arrow P indicates the lower side of the same. The heat-pipe body 110 is an extrudate of aluminum or its alloy, like the heat-pipe body 10, 61, and 71 of the previously-described embodiments.

The heat-sink device is provided with a first and a second header pipe 112 and 114 at longitudinal ends of the heat-pipe body 110. The first and second header pipes 112, 114 have therein a first and a second communication passage, respectively. As shown in FIG. 14, each passage-defining portion. 126 has therein a flow passage 124. The first and second header pipes 112, 114 are joined to the heat-pipe body 110, such that each flow passage 124 communicates with either of the first and second communication passages of the first and second header pipes 112, 114. The upper end 117 of the first header pipe 112 and the upper and lower ends 118, 119 of the second header pipe 114 are fluid-tightly closed by welding. After remaining air is discharged from the flow passage 124 of the heat-pipe body 110 and the first and second communication passages of the first and second header pipes 112, 114, the body 110 and the pipes 112, 114 are charged to the level of L (FIG. 12), i.e., up to around 50% by volume with a working fluid for transferring heat. As the working fluid, is used Flon R12 and the like. A sealing cap 116 fluid-tightly seals the lower end of the first header pipe 112.

On the front face of the heat-pipe body 110 of FIG. 12, i.e., on the upper face of the body 110 of FIG. 13, is disposed heat-radiating means in the form of a fin member 120. The fin member 120 has a plurality of fins which are spaced apart a predetermined distance from each other along the longitudinal direction of the heat-pipe body 110. Each fin has a rectangular cross section.

The members 112, 114, 116, 120 have a coat of brazing materials. After the heat-pipe body 110 and those members 112, 114, 116, 120 are fabricated together into an assembly, the thus-obtained assembly is heated in a vacuum heating furnace so that all the members 110, 112, 114, 116, 120 are brazed to each other. This is the so-called vacuum brazing process.

The heat-pipe body 110 which is an extrudate of aluminum or its alloy has a planer-structure portion 122. The planer-structure portion 122 has at one of opposite sides thereof a flat face 128 to which a heat-generating element 130 is directly fixed. The passage-defining portions 126 protrude from the other side of the planer-structure portion 122, and extend parallel to, and apart a predetermined distance from, each other. The passage-defining portions 126 cooperate with the planer-structure portion 122 to define a corrugation face 129 on the other side of the portion 122. As shown in FIG. 12, the heat-pipe body 110 has four passage-defining portions 126, and the planer-structure portion 122 has four areas (parts) free from the passage-defining portions 126.

The heat-generating element 130, such as a thermomodule, is fixed to a middle portion of the lower part of the heat-pipe body 110, with the help of screws 132 which are screwed through the areas of the planer-structure portion 122 that are free from the passage-defining portions 126. Filler materials, such as a silicone resin, are applied to the interface between the heat-generating element 30 and the flat face 128, so as to increase the degree of fixation of the element 30 to the body 110.

In this embodiment, the heat-pipe body 110 is disposed substantially vertical, and the heat-generating element 130 is fixed to the middle portion of the lower part of the heat-pipe body 110. Heated by heat generated by the heat-generating element 130, the working fluid within the low-positioned two flow passages 124 of the heat-pipe body 110 is vaporized. The gaseous working fluid flows bidirectially within the two flow passages 124, and then moves up within the first and second communication passages of the first and second header pipes 112, 114. Eventually, the gaseous working fluid reaches the high-positioned two flow passages 124 where the working fluid is cooled and condensed into liquid. The liquid working fluid flows backward to the low-positioned flow passages 124 of the heat-pipe body 110.

Accordingly, heat flow from the heat-generating element 130 is transmitted by the working fluid through four channels, that is, the two channel toward the first header pipe 112 plus the two channel toward the second header pipe 114. Thus, the instant heat-sink device has an increased heat-transmission efficiency. Further, this heat-sink device has another advantage that the surface temperature of the heat-pipe body 110 has a more uniform distribution than in conventional heat-sinks.

Figure 15:
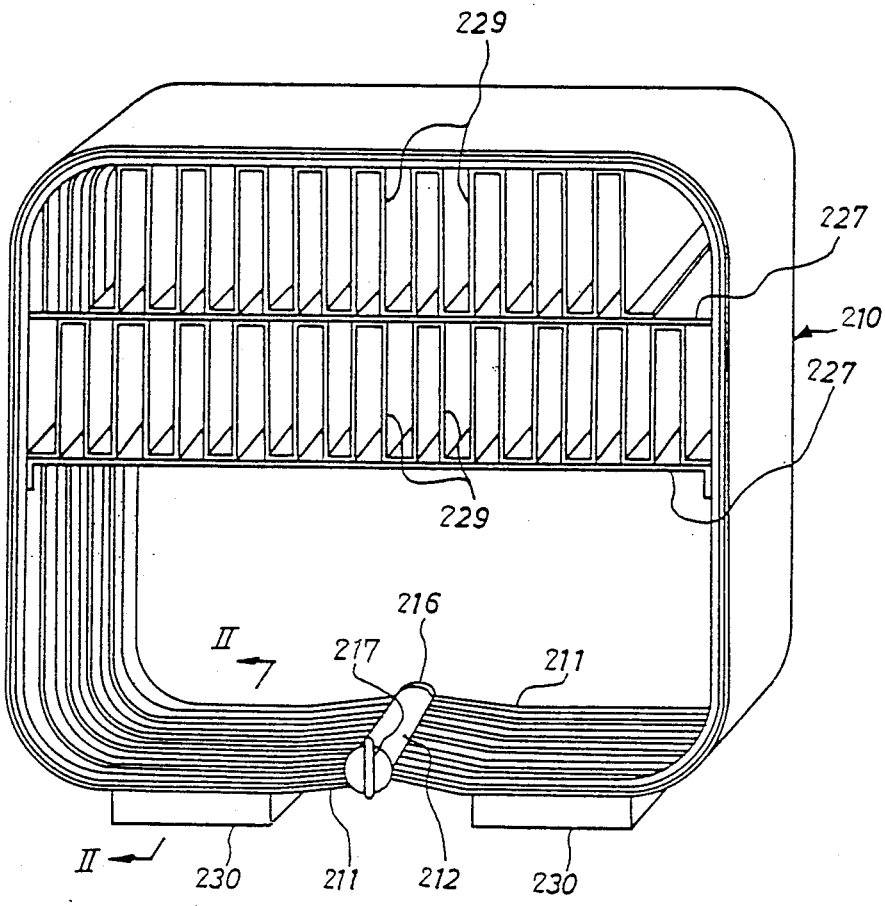
FIG. 15 is a further embodiment of the heat-sink device according to the invention.

Referring to FIG. 15, there is shown still another embodiment of the heat-sink device according to the present invention, for reducing the temperature of a heat-generating element such as a semiconductor device. The heat-sink device consists mainly of three heat-pipe bodies 210. Each heat-pipe body 210 is an extrudate of plate-like configuration made of aluminum or its alloy (which will be described). The three heat-pipe bodies 10 are joined to each other and bent to form a substantially box-like (square cross section) configuration with their corners rounded.

The longitudinal ends of the joined heat-pipe bodies 210 are connected to each other by way of a header pipe 212 which is located at the middle portion of the bottom wall of the heat-sink device. The header pipe 212 is made of a pipe coated with brazing materials. The heat-pipe body 210 has slope portions 211 on both sides of the header pipe 212.

A first sealing cap 216 is fluid-tightly fixed by brazing to one of opposite ends of the header pipe 212. To the other end of the header pipe 212 is fixed a second sealing cap 217. The second sealing cap 217 is closed by welding. The first and second sealing caps 216, 217 are made of a metal sheet coated with brazing materials.

Figure 16:
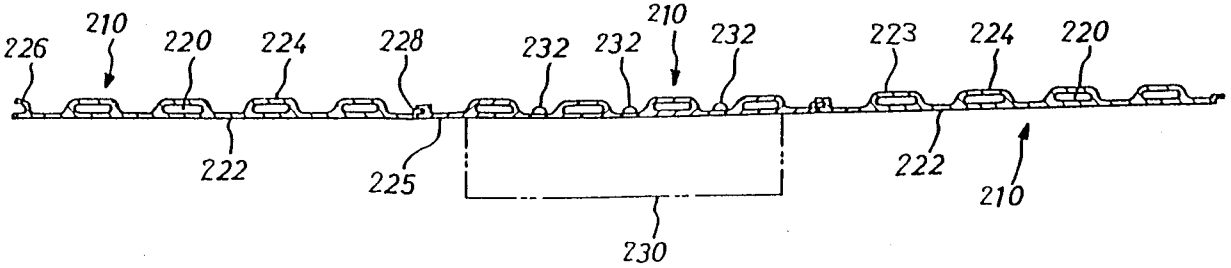
FIG. 16 is a cross sectional view of a heat-pipe body of the heat-pipe device of FIG. 15, taken along line XVI—XVI.

As shown in FIG. 16 corresponding to FIG. 4, each heat-pipe body 210, an extrudate of aluminum or the like, includes a planer-structure portion 222 and four passage-defining portions 224 each of which has therein a flow passage 220. The planer-structure portion 222 has on one of opposite sides thereof a flat face 225. The four passage-defining portions 224 protrude from the other side of the planer-structure portion 222, and extend parallel to, and apart a predetermined distance from, each other. The passage-defining portions 224 cooperate with the planer-structure portion 222 to define a corrugation face 223 on the other side of the portion 222. Each heat-pipe body 210 has a first and a second joint portion 226, 228 at transverse ends thereof other than its longitudinal ends thereof. The first joint portion 226 of one heat-pipe body 210 and the second joint portion 228 of the next heat-pipe body 210 are joined to each other by fitting and then caulking.

The header pipe 212 has therein a communication passage. The longitudinal ends of the joined heat-pipe bodies 210 is joined to the header pipe 212 as follows; first, the heat-pipe bodies 210 is worked or cut so as to protrude the ends of the passage-defining portions 224 from the rest of the bodies 210 at the respective longitudinal ends of the bodies 210, and then the protruding ends of the heat-pipe bodies 210 are inserted into holes which are formed in the header pipe 212. The joint portions between the protruding ends of the bodies 210 and the pipe 212 are fluid-tightly sealed by brazing.

After remaining air within the flow passages 220 and the communication passage of the header pipe 212 is discharged by suction, those passages are charged to the extent of 10 to 50% by volume with a working fluid for transmitting heat, for example, a mixture of methanol, acetone, flon and the like.

On the upper part of the internal face (corrugation face 223) of the instant heat-sink device (heat-pipe body 210), is disposed heat-radiating means in the form of a fin member 229. The fin member 229 is supported by a pair of transverse plates 227 which are fixed to the bodies 210. The transverse plates 227 are made of an alumimum plate, whereas the fin member 229 is made of sheet coated with brazing materials.

After fabrication of the members 210, 212, 216, 217, 227, 229 into an assembly, the obtained assembly is heated to be brazed in a vacuum heating furnace in the so-called vacuum brazing process. In this brazing process, the brazing materials provided on the members 212, 216, 217, 229 are melted to braze the assembly.

As shown in FIG. 15, a heat-generating element 230 such as a thyristor is fixed to the external face (flat face 225 of FIG. 16) of the bottom wall of the instant heat-sink device (heat-pipe body 210). The element 230 is in close contact with the bodies 210 over the entire interface therebetween. The thyristor 23 is fixed to the flat face 225 of the heat-pipe bodies 210 by the help of screws 232 which are screwed through the areas of the planer-structure portion 222 free from the passage-defining portions 224. Since the slope portions 211 of the bodies 210 are provided for the purpose of creating space for the header pipe 212, the slope portions 211 may be omitted in the case where the heat-generating element 230 is fixed to the lower face of the bottom wall of the present heat-sink device.

As described in detail hitherto, each heat-pipe body 210 has four flow passages 220 in which the working fluid flows. Accordingly, the heat-pipe body 210 has an increased capacity of heat transmission.

Furthermore, the heat-body 210 enjoys the same advantages as those of the embodiments previously described. The heat-pipe body 210 has a decreased heat resistance, since the body 210 is an extrudate which includes, as integral parts, the planer-structure portion 220 and the passage-defining portions 224, that is, since the body 210 has a continuous metal structure. Accordingly, heat flow is rapidly transmitted from the passage-defining portions 224 to the planer-structure portion 222. The heat flow transmitted to the planer-structure 222 is then transmitted to the heat-generating element 230 in close contact with the flat face 225 of the portion 220, so as to cool the element 230.

In the above case, it is noted that the heat flow is transmitted to the heat-generating element 230 through a large area, that is, the entire interface between the element 230 and the heat-pipe body 210 which are in close contact with each other. Therefore, the element 30 is advantageously cooled.

If vaporized within the communication passage of the header pipe 212, the working fluid begins to flow bidirectionally, i.e., into the flow passages 220 on both sides of the header pipe 212. While flowing in the flow passages 220 above the heat-generating element 230, the working fluid absorbs heat generated by the element 230, through the flat face 225. Then, the gaseous working fluid moves up in the vertical portions of the flow passages 220 toward the upper part of the heat-pipe bodies 210. The fin member 229 disposed on the upper part of the heat-pipe bodies 210 serves for cooling down the temperature of the working fluid, so that the working fluid is condensed into liquid. The condensed working fluid flows backward in the flow passages 220 toward the header pipe 220.

Figure 17:
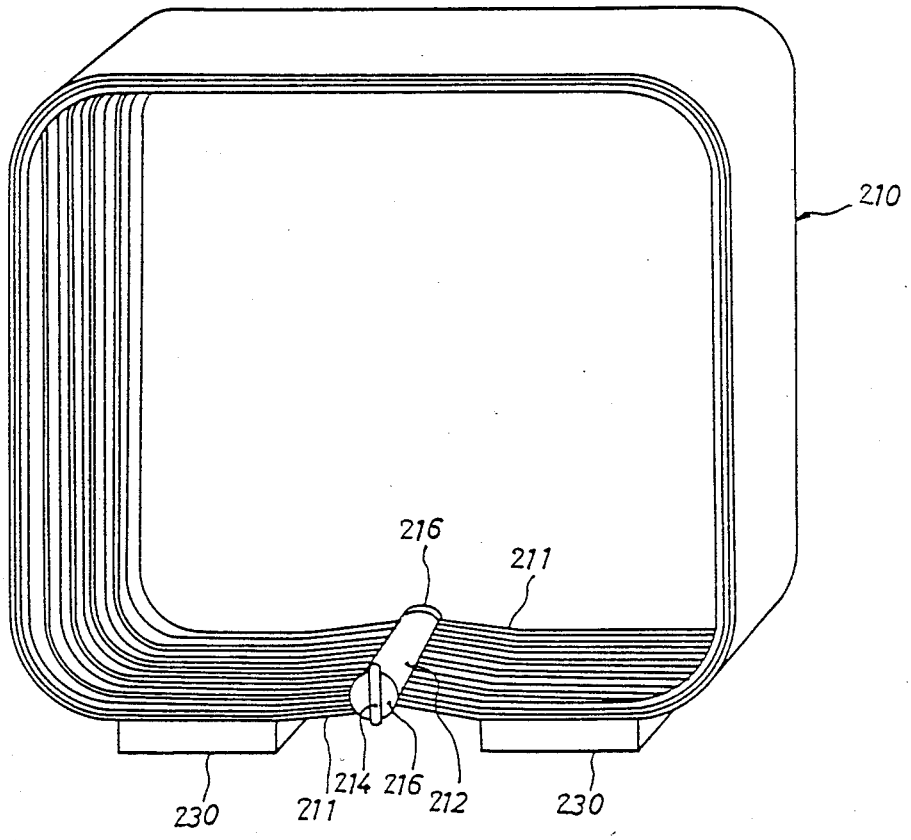
FIG. 17 is a still further embodiment of the heat-sink device of the invention.

In the case where the heat-generating element 230 is of a low class, i.e., in the case where the amount of heat generated by the element 230 is small, the fin member 229 and the transverse plate 227 may be omitted as shown in FIG. 17.

In this embodiment, heat generated by the heat-generating element 230 is rapidly transmitted to the upper part of the heat-pipe bodies 210 where is provided the fin member 229, since the header pipe 212 is disposed in the bottom wall of the heat-pipe bodies 210. Thus, the instant heat-sink device has an improved heat-transmission efficiency or cooling effect, as well as an increased heat-transmission capacity.

The instant heat-sink device has a simple construction due to use of a sole header pipe 212.

Figure 18:
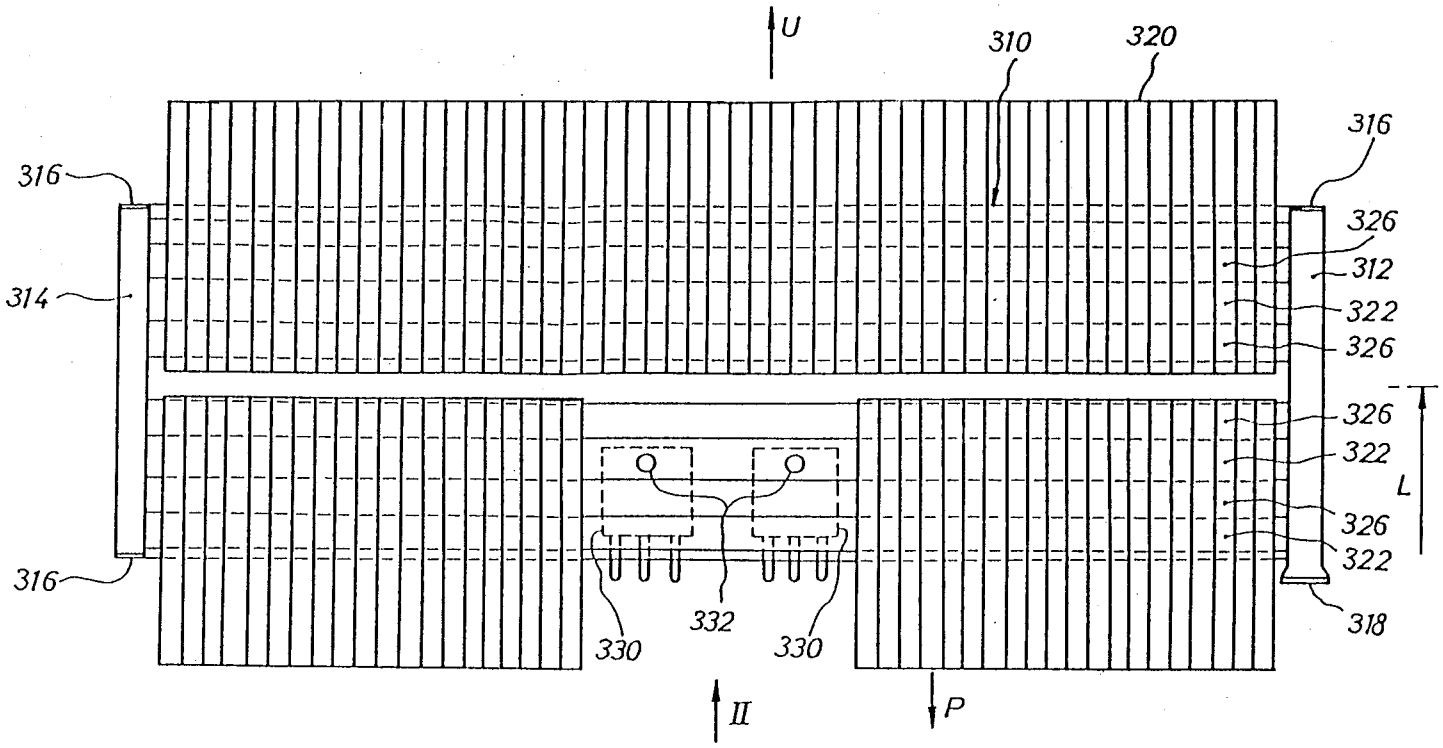
FIG. 18 is a view of still another embodiment of the heat-sink device of the invention.
Figure 19:
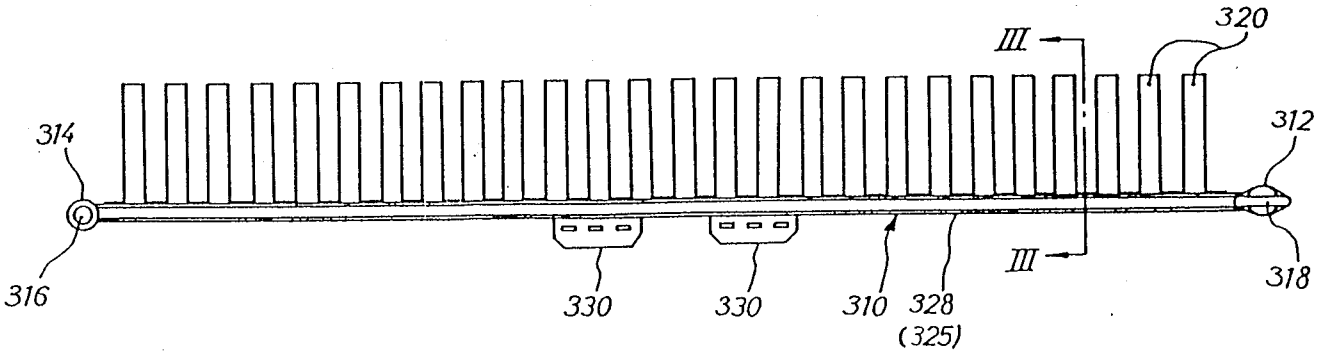
FIG. 19 is a view of the heat-sink device of FIG. 18, as seen along arrow XIX.
Figure 20:
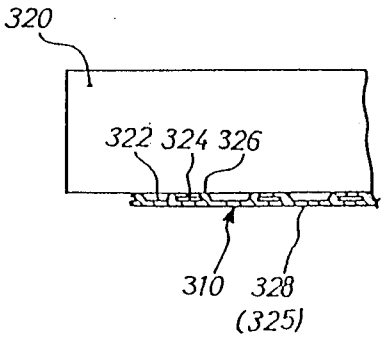
FIG. 20 is a cross sectional view of a heat-pipe body of the heat-sink device of FIG. 18, taken along line XX—XX of FIG. 18.

Referring to FIGS. 18 through 20, there is shown a still further embodiment of the heat-sink device according to the present invention. The instant heat-sink device is used for cooling a heat-generating element such as a semiconductor device, like the previously-described embodiments.

In the front elevational view of FIG. 18, reference numeral 310 designates a heat-pipe body of plate-like configuration which is an extrudate of aluminum or its alloy (which will be described). The heat-sink device is disposed substantially vertical, such that a plurality of passage-defining portions 326 of the heat-pipe body 310 run in a substantially horizontal direction. In the figure, arrow U indicates the upper side of the heat-sink device, while arrow P indicates the lower side. Each passage-defining portion 326 of the heat-pipe body 310 has therein a flow passage 324 which is fluid-tightly charged with a working fluid for transmitting heat generated by a heat-generating element 330.

The longitudinal ends of the heat-pipe body 310 are connected to a first and second header pipe 312, 314, respectively, such that each flow passage 324 is open in a first and second communication passage of the first and second header pipes 312, 314, respectively. The upper end of the first header pipe 312 and the upper and lower ends of the second header pipe 314 are sealed by respective sealing caps 316, 316, 316. The remaining air within the flow passages 424 and the first and second communication passages of the first and second header pipes 312, 314 is discharged by suction, and then those passages of the heat-sink device is charged with the working fluid such as Flon R12, up to the level L (FIG. 18), i.e., up to around 50% by volume. The lower end 318 of the first header pipe 312 is fluid-tightly closed by welding.

On the front face of the heat-pipe body 310 (FIG. 18), i.e., on the top face of the body 310 (FIG. 19), there is provided heat-radiating means in the form of a fin member 320. As shown in FIG. 19, the fin member 220 has a number of fins which has a rectangular cross section. The fins of the fin member 320 are spaced apart a predetermined distance from each other, along the longitudinal direction of the heat-pipe body 310.

The members 312, 314, 316 320 are made of a metal sheet coated with brazing materials, i.e., a so-called brazing sheet. After all the members 312, 314, 316, 320 are fabricated into an assembly, the thus-obtained assembly is brazed by heating in a vacuum heating furnace, in a so-called vacuum brazing process.

As clearly shown in FIG. 20, the heat-pipe body 310, an extrudate of aluminum or the like, includes the above-indicated passage-defining portions 326 and a planer-structure portion 322. The planer-structure portion 322 has on one of opposite sides thereof a flat face 328 to which the heat-generating element 330 is fixed. The planer-structure portion 322 cooperates with the plurality of passage-defining portions 326 to define on the other side thereof a corrugation face 323 on which the fin member 320 is disposed. The plurality of passage-defining portions 326 protrude from the other side of the planer-structure portion 322, and extend parallel to, and apart a predetermined distance from, each other. Each passage-defining portion 326 has a generally flattened-tube configuration. In this embodiment, the heat-pipe body 310 has four passage-defining portions 326, and four alternate areas of the planer-structure portion 322 free from the passage-defining portions 326.

As described previously, the heat-pipe body 310 is disposed substantially vertical, such that the four passage-defining portions 326 run in the substantially horizontal direction. Thus, the working fluid flows in the flow passages 324 in the substantially horizontal direction.

The heat-generating element 330 is fixed to a middle portion of the lower part of the heat-pipe body 300 with the help of screws 332 which are screwed through the areas of the planer-structure portion 322 free from the passage-defining portions 326. The element 330 may be a pair of thyristors of tab-mount type. Filler materials are applied to the interface between the heat-generating element 330 and the flat face 328 of the heat-pipe body 310, so as to increase the degree of fixation therebetween. Filler materials may be a silicone resin, for example. Around the heat-generating element 330, the heat-pipe body 310 has no fin member 320.

Since the heat-generating element 330 is fixed to the middle portion of the lower part of the vertical heat-pipe body 310, the working fluid vaporized by heat from the element 330 begins to flow bidirectionally, i.e., toward the first and second header pipes 312, 314, in the two low-positioned flow passages 324. Then the gaseous working fluid moves up in the first and second communication passages of the first and second header pipes 312, 314, toward the upper part of the heat-pipe body 310 where the working fluid is cooled and condensed into liquid. The liquid working fluid flows backward toward the lower part of the heat-pipe body 310.

Since the working fluid vaporized by heat from the heat-generating element 330 flows bidirectionally in each of the two low-positioned flow passages 324, heat from the element 330 is transmitted through four channels. Accordingly, the heat-transmission efficiency of the instant heat-sink device is an increased one. Further, the overall surface of the heat-pipe body 310 keeps a more uniform temperature than in conventional heat-pipes.

Since one heat-pipe body 310 has four flow passages 324, the body 310 enjoys an increased heat-transmission capacity.

Furthermore, since the heat-pipe body 310 is an extrudate of aluminum or its alloy, i.e., since the body 310 has a continuous metal structure at the connections between the planer-structure portion 322 and the passage-defining portions 326, the body 310 has a reduced heat resistance. Therefore, heat flow is rapidly transmitted from the passage-defining portions 326 to the planer-structure portion 322. The heat flow transmitted to the portion 322 is transferred to the heat-generating element 330 closely fixed to the flat face 328 of the body 310, so as to cool down the temperature of the element 330.

Since the heat-generating element 330 fixed is in close contact with the flat face 328 (FIGS. 19, 20) of the heat-pipe body 310, over the entire interface therebetween, the heat flow is transmitted between the element 330 and the body 310, through a large area, i.e., the entire interface therebetween. This arrangement contributes to rapidly cooling the heat-generating element 30.

Referring to FIGS. 21 to 24, there are shown four examples of conventional heat pipes.

Figure 21:
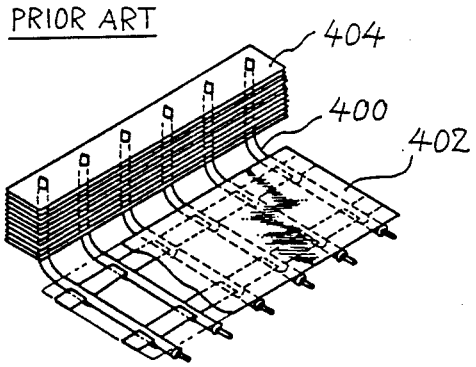
FIG. 21 PRIOR ART
FIGS. 21 through 24 are schematic views of conventional heat pipes, respectively.

FIG. 21 shows a heat pipe disclosed by the previously indicated Japanese Patent Application Publication No. 60-26268, which includes a plurality of separate passage pipes 400, and a fin member 404 and a plate 402 which are attached to the passage pipes 400.

Figure 22:
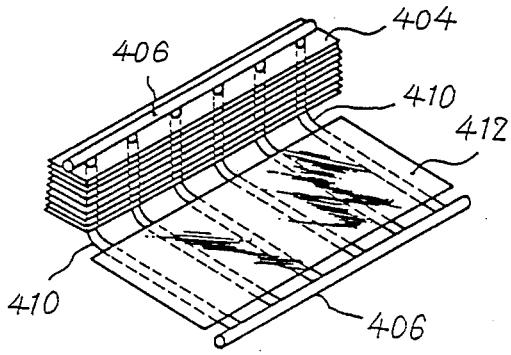
FIG. 22 PRIOR ART

FIG. 22 shows another conventional heat pipe in which a plurality of passage pipes 410 communicate with each other by way of a pair of communication header pipes 406, and in which a fin member 414 and a plate member 412 are attached to the passage pipes 410.

Figure 23:
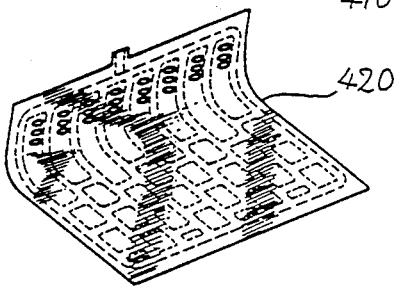
FIG. 23 PRIOR ART

FIG. 23 shows a further heat-pipe known in the art which is manufactured by a so-called "roll-bond" method. A plurality of passages are formed between a pair of plate members 420 which are rolled under pressure.

Figure 24:
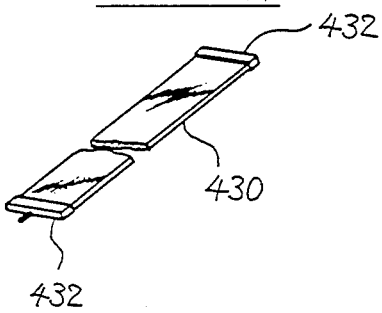
FIG. 24 PRIOR ART

FIG. 24 shows the fourth example of conventional heat pipes which includes an extrudate member 430 which has therein a plurality of flow passages and a pair of header pipes 432 which are attached to the extrudate member 430.

While the present invention has been described in its preferred embodiments for the illustrative purpose only, it is to be understood that the invention is by no means confined to the details of the illustrated embodiments, but may be otherwise embodied without departing from the scope and spirit of the invention.

What is claimed is:

1. A heat-pipe device for transferring heat generated by a heat-generating element, comprising:

at least one heat-pipe body which is an extrudate of plate-like configuration made of aluminum or its alloy, said at least one heat-pipe body including a planar-structure portion which has on one of opposite sides thereof a flat face to which said heat-generating element is directly fixed, the at least one heat-pipe body further including a plurality of passage-defining portions which protrude from the other side of said planar-structure portion and extend parallel to each other, each passage-defining portion being spaced apart from the other passage-defining portions in a direction perpendicular to a longitudinal direction of the passage-defining portions and having therein a flow passage which is fluid-tightly charged with a working fluid for transferring said heat generated by said heat-generating element, and the at least one heat-pipe body including a vaporizer section to which the heat-generating element is fixed and wherein the charged working fluid is gasified, and a condenser section remote from the vaporizer section in which the gasified working fluid is fluidized, and each of said plurality of passage-defining portions having a flattened tube configuration, whereby the plurality of passage-defining portions cooperate with said planar-structure portion to define a corrugation face on the other side of the planar-structure portion.

2. A heat-pipe device for transferring heat generated by a heat-generating element, comprising:

at least one heat-pipe body which is an extrudate of plate-like configuration made of aluminum or its alloy, said at least one heat-pipe body including a planar-structure portion which has on one of opposite sides thereof a flat face to which said heat-generating element is directly fixed, the at least one heat-pipe body further including a plurality of passage-defining portions which protrude from the other side of said planar-structure portion and extend parallel to each other, each passage-defining portion being spaced apart from the other passage-defining portions in a direction perpendicular to a longitudinal direction of the passage-defining portions and having therein a flow passage which is fluid-tightly charged with a working fluid for transferring said heat generated by said heat-generating element, each of said plurality of passage-defining portions having a flattened tube configuration, whereby the plurality of passage-defining portions cooperate with said planar-structure portion to define a corrugation face on the other side of the planar-structure portion, a first and a second header pipe which have therein a first and second communication passage, respectively, wherein each of said flow passages of said plurality of passage-defining portions is open, at longitudinal ends of the corresponding passage-defining portion, in said respective first and second communication passages of said first and second header pipes.

3. A heat-sink device for cooling a heat-generated element, comprising:

at least one heat-pipe body which is an extrudate of plate-like configuration made of aluminum or its alloy, said at least one heat-pipe body including a planar-structure portion which has on one of opposite sides thereof a flat face to which said heat-generating element is directly fixed, the at least one heat-pip body further including a plurality of passage-defining portions which protrude from the other side of said planar-structure portion and extend parallel to each other, each passage-defining portion being spaced apart from the other passage-defining portions in a direction perpendicular to a longitudinal direction of the passage-defining portions and having therein a flow passage which is fluid-tightly charged with a working fluid for transferring said heat generated by said heat-generating element, wherein the charged working fluid is vaporized in the vicinity of a first portion of the at least one heat-pipe body to which the heat-generating element is fixed, and that the vaporized working fluid is condensed at a second portion of the at least one heat-pipe body which is remote from said first portion, and wherein each of said plurality of passage-defining portions has a flattened tube configuration, whereby the plurality of passage-defining portions cooperate with said planar-structure portion to define a corrugation face on the other side of the planar-structure portion.

4. A heat-sink device for cooling a heat-generating element, comprising:

at least one heat-pipe body which is an extrudate of plate-like configuration made of aluminum or its alloy, said at least one-pipe body including a planar-structure portion which has on one of opposite sides thereof a flat face to which said heat-generating element is directly fixed, the at least one heat-pipe body further including a plurality of passage-defining portions which protrude from the other side of said planar-structure portion and extend parallel to each other, each passage-defining portion being spaced apart from the other passage-defining portions in a direction perpendicular to a longitudinal direction of the passage-defining portions and having therein a flow passage which is fluid-tightly charged with a working fluid for transferring said heat generated by said heat-generating element, each of said plurality of passage-defining portions having a flattened tube configuration, whereby the plurality of passage-defining portions cooperate with said planar-structure portion to define a corrugation face on the other side of the planar-structure portion, a first and a second header pipe which have therein a first and a second communication passage, respectively, wherein each of said flow passages of said plurality of passage-defining portions is open, at longitudinal ends of the corresponding passage-defining portion, in said respective first and second communication passages of said first and second header pipes.

5. A heat-sink device according to claim 4, wherein said at least one heat-pipe body is bent to form a substantially box-like configuration, such that said first and second header pipes are positioned adjacent to each other.

6. A heat-transfer device for transferring heat generated by a heat-generating element, comprising:

at least one extruded body which is of plate-like configuration made of aluminum or its alloy, said at least one extruded body including a planar-structure portion which has on one of opposite sides thereof a flat face to which said heat-generating element is directly fixed, the at least one extruded body further including a plurality of passage-defining portions which protrude from the other side of said planar-structure portion and extend parallel to each other, each passage-defining portion being spaced apart from the other passage-defining portions in a direction perpendicular to a longitudinal direction of the passage-defining portions and having there in a flow passage which is fluid-tightly charged with a working fluid for transferring said heat generated by said heat-generating element, wherein the charged working fluid is vaporized in the vicinity of a first portion of the at least one heat-pipe body to which the heat-generating element is fixed, and that the vaporized working fluid is condenses at a second portion of the at least one heat-pipe body which is remote from said first a portion, and wherein each of said plurality of passage-defining portions has a flattened tube configuration, whereby the plurality of passage-defining portions cooperate with said planar-structure portion to define a corrugation face on the other side of the planar-structure.

7. A heat-transfer device according to claim 6, wherein said at least one extruded body comprises a plurality of extruded bodies, said plurality of extruded bodies being joined to each other at at least one joint portion of each extruded body which defines a transverse end thereof parallel to the passage-defining portions.

8. A heat-transfer device for transferring heat generated by a heat-generating element, comprising:

at least one extruded body which is of plate-like configuration made of aluminum or its alloy, said at least one extruded body including a planar-structure portion which has on one of opposite sides thereof a flat face to which said heat-generating element is directly fixed, the at least one extruded body further including a plurality of passage-defining portions which protrude from the other side of said planar-structure portion and extend parallel to each other, each passage-defining portion being spaced apart from the other passage-defining portions in a direction perpendicular to a longitudinal direction of the passage-defining portions and having therein a flow passage which is fluid-tightly charged with a working fluid for transferring said heat generated by said heat-generating element, each of said plurality of passage-defining portions having a flattened tube configuration, whereby the plurality of passage-defining portions cooperate with said planar-structure portion to define a corrugation face on the other side of the planar-structure portion, a first and a second header pipe which have therein a first and a second communication passage, respectively, wherein each of said flow passages of said plurality of passage-defining portions is open, at longitudinal ends of the corresponding passage-defining portion, in said respective first and second communication passages of said first and second header pipes.

9. A heat-transfer device according to claim 8, wherein each of said first and second header pipes are fluid-tightly sealed at opposite ends thereof.

10. A heat-transfer device according to claim 8, wherein said at least one extruded body is bent to form a substantially box-like configuration, while said first and second header pipes are positioned adjacent to each other.

11. A heat-transfer device according to claim 10, wherein said flat face of said at least one extruded body defines an external face of the heat-transfer device, said heat-generating element being fixed to said external face of the heat-transfer device.

* * * * *